US007146885B2

(12) United States Patent
Hwang et al.

(10) Patent No.: US 7,146,885 B2
(45) Date of Patent: Dec. 12, 2006

(54) SECTIONLESS LENGTH ADJUSTMENT MECHANISM FOR TOOL SHANK

(76) Inventors: Ting Hwang, No.52, Lane 197, Jhongshan N. Rd., Daya, Taichung (TW); Yi-Chun Tseng, No.3, Lane 22, Sec. 2, Tanfu Rd., Tanzi, Taichung (TW)

( * ) Notice: Subject to any disclaimer, the term of this patent is extended or adjusted under 35 U.S.C. 154(b) by 176 days.

(21) Appl. No.: 11/027,200

(22) Filed: Dec. 29, 2004

(65) Prior Publication Data

US 2006/0137495 A1 Jun. 29, 2006

(51) Int. Cl.
*B25G 1/04* (2006.01)
*B25B 13/58* (2006.01)
*B25B 15/00* (2006.01)
*B25B 23/00* (2006.01)

(52) U.S. Cl. ..... 81/177.2; 81/183; 81/436

(58) Field of Classification Search ..... 81/177.2, 81/177.4, 177.1, 177.85, 183, 436–439
See application file for complete search history.

(56) References Cited

U.S. PATENT DOCUMENTS 3,292,678 A * 12/1966 Noga ..... 81/475
4,586,406 A * 5/1986 Howard ..... 81/177.2
5,287,778 A * 2/1994 Cook ..... 81/442
6,029,551 A * 2/2000 Wu ..... 81/475
6,601,483 B1 * 8/2003 Wannop ..... 81/490
6,622,597 B1 * 9/2003 Chen ..... 81/58.3
6,655,240 B1 * 12/2003 DeVecchis et al. ..... 81/438
6,684,740 B1 * 2/2004 Lin ..... 81/438
6,722,667 B1 * 4/2004 Cantlon ..... 279/22
6,889,582 B1 * 5/2005 Wilhelm ..... 81/177.85
6,901,826 B1 * 6/2005 Huang ..... 81/177.2

* cited by examiner

*Primary Examiner*—Lee D. Wilson
*Assistant Examiner*—Alvin J. Grant
(74) *Attorney, Agent, or Firm*—W. Wayne Liauh

(57) ABSTRACT

Disclosed is a sectionless length adjustment mechanism for the shank of a tool (e.g., screwdriver) and for releasably locking the shank in any one of a plurality of positions relative to the handle. In one embodiment the mechanism comprises a sleeve having a front flared end, a spring anchored in the sleeve, a shell including two opposite bars on its surface, and a nut secured to the sleeve. Pulling the shank forward will move the bars outward forward along the flared end to expand the spring. Pushing the shank rearward will move the bars inward rearward along the flared end to compress the spring. Stopping sliding will lockingly engage the shank. Loosening the nut will move the shell forward and expand the spring until the shank is free to slide with the bars disposed at a mouth of the flared end and disengaged from the shank.

7 Claims, 14 Drawing Sheets

A–A

SECTIONLESS LENGTH ADJUSTMENT MECHANISM FOR TOOL SHANK

BACKGROUND OF THE INVENTION

1. Field of the Invention

The present invention relates to mechanisms which enable to adjust the length of a tool shank and more particularly to an improved mechanism capable of adjusting length of the shank of a tool (e.g., screwdriver) in a sectionless manner.

2. Description of Related Art

Screwdrivers having a length adjustable shank are well known. Typically, the adjustment is limited to a number of fixed positions. That is, the length of screwdriver can only be adjusted to one of a plurality of predetermined ones. Such adjustment is not satisfactory. Thus, a prior mechanism capable of adjusting length of a screwdriver in a sectionless manner is available as shown in FIGS. 1 to 3. A sleeve 2 is forwardly extended a short distance from a handle 1. The sleeve 2 has a bore of hexagonal section. A length adjustment mechanism is provided in the handle 1 and comprises a shell 3 having a plurality of balls 4 equally spaced around its outer surface and an enlarged aperture plate in its front end, a cylinder 5 having a bore with a front flared end 6 such that the balls 4 are adapted to urge against the flared end 6 of the bore when the cylinder 5 is put on the shell 3, a coil spring 7 compressed between a rear end of the shell 3 and an internal shoulder of the handle 1, a cylindrical member 8 having outer threads adapted to threadedly secure to inner threads of the handle 1 with the spring 7 disposed therein, a first ring 9 having a plurality of grooves 10 put on the shell 3, front and rear second rings 11 in which the front second ring 11 is sandwiched between the first ring 9 and the aperture plate of the shell 3, the rear second ring 11 is sandwiched between the first ring 9 and a front end of the cylinder 5, and each second ring 11 has a plurality of peripheral slopes 12 matingly engaged with the grooves 10, and a spring biased sliding button 14 having a knurled surface provided in a slot 13 on an outer surface of the handle 1, the button 14 has its bottom fastened by the first ring 9. A shank 15 inserted through the sleeve 2 and the shell 3 has its rear end slidably fastened in the handle 1. In an inoperative state, the spring 7 is expanded to position the above components in which the shank 15 is fastened by the inwardly urged balls 4.

For adjusting length of the shank 15 (see FIGS. 2 and 3), slide the button 14 from one position (e.g., one end of the slot 13) to the other position (e.g., the other end of the slot 13). As such, the first ring 9 is actuated to push the second rings 11 rearward and forward respectively as a result of a coaction of the grooves 10 and the slopes 12. And in turn, the shell 3 moves forward to further compress the spring 7 and thus move the balls 4 toward the mouth of the flared end 6 (i.e., having a larger diameter). The shank 15 is disengaged from the balls 4 and is thus free to slide. That is, a user can adjust the length of the shank 15 at this operative state. Alternatively, rather than sliding the button 14 the user may exert a great force to pull the shank 15 outward or push the shank 15 inward directly for carrying out the above adjustment.

However, the prior mechanism suffered from the following disadvantages including being relatively complex in construction, costly to manufacture, trouble-prone, unreliable in use, much force being exerted in the length adjusting operation, and compromised shank fastening after a short period of use time. Thus, the need for improvement still exists.

SUMMARY OF THE INVENTION

It is an object of the present invention to provide a sectionless length adjustment mechanism mountable in a joining portion of a handle of a tool and a shank of multi-sided section thereof for releasably locking the shank in any one of a plurality of positions relative to the handle, comprising a sleeve forwardly extended from the handle, the sleeve including a multi-sided bore of staged, a front flared end, an externally threaded section around the flared end, and an inner portion with reduced diameter, the bore of the sleeve being in communication with an internal bore of the handle; a resilient member having its rear end contacted a slope of the bore of the sleeve; a shell including two opposite slots formed on its outer surface and being in communication with its inside, and two bars provided in the slots, the shell having its rear end contacted a front end of the resilient member; and a nut threadedly secured to the externally threaded section of the sleeve and including a C-shaped second resilient member obliquely compressed between a front end of the shell and a front inner wall thereof, wherein the shank is inserted through the nut, the shell, the resilient member, and the bore of the sleeve to have its rear end slidably fastened in the bore of the handle with outer portions of the bars being in contact with internal faces of the flared end, and inner portions of the bars being in contact with faces of the shank, whereby pulling the shank forward will move the bars outward forward along the flared end to expand the resilient member for extending the shank, and stopping sliding the shank will lockingly engage the shank; pushing the shank rearward will move the bars inward rearward along the flared end to compress the resilient member for retracting the shank, and stopping sliding the shank will lockingly engage the shank; and loosening the nut will move the shell forward and expand the resilient member until the shank is free to slide with the bars disposed at a mouth of the flared end and disengaged from the shank.

It is another object of the present invention to provide a sectionless length adjustment mountable in a joining portion of a handle of a tool and a shank of multi-sided section thereof for releasably locking the shank in any one of a plurality of positions relative to the handle, comprising a sleeve forwardly extended from the handle, the sleeve including a multi-sided bore of staged, a front flared end, a first annular groove proximate its front end, a first C-shaped clip put on the first annular groove, and an inner portion with reduced diameter, the bore of the sleeve being in communication with an internal bore of the handle; a first resilient member having its rear end contacted a slope of the bore of the sleeve; a shell including two opposite slots formed on its outer surface and being in communication with its inside, and two bars provided in the slots, the shell having its rear end contacted a front end of the resilient member; a cap including a central aperture, a second annular groove proximate its rear end, and a second C-shaped clip put on the second annular groove; a second resilient member put on the front end of the sleeve and compressed between the first and second C-shaped clips in response to mounting the cap on the front end of the sleeve, wherein the shank is inserted through the cap, the shell, the first resilient member, and the bore of the sleeve to have its rear end slidably fastened in the bore of the handle with outer portions of the bars being in contact with internal faces of the flared end, and inner portions of the bars being in contact with faces of the shank, whereby pulling the shank forward will move the bars outward forward along the flared end to disengage from the shank and disengage the front end of the sleeve from the cap with the second resilient member being compressed and the first resilient member being expanded for extending the shank, and stopping sliding the shank will lockingly engage the shank; pushing the shank rearward will move the bars inward rearward along the flared end to compress the first resilient member and expand the second resilient member for retracting the shank, and stopping sliding the shank will lockingly engage the shank; and pull the cap forward will move the shell forward and expand the second resilient member until the shank is free to slide with the bars disposed at a mouth of the flared end and disengaged from the shank.

In one aspect of the present invention the resilient member is a spring.

In another aspect of the present invention each of the shank, the bore of the sleeve, and the bore of the handle is of hexagon.

The above and other objects, features and advantages of the present invention will become apparent from the following detailed description taken with the accompanying drawings.

DETAILED DESCRIPTION OF THE PREFERRED EMBODIMENTS

Figure 1:
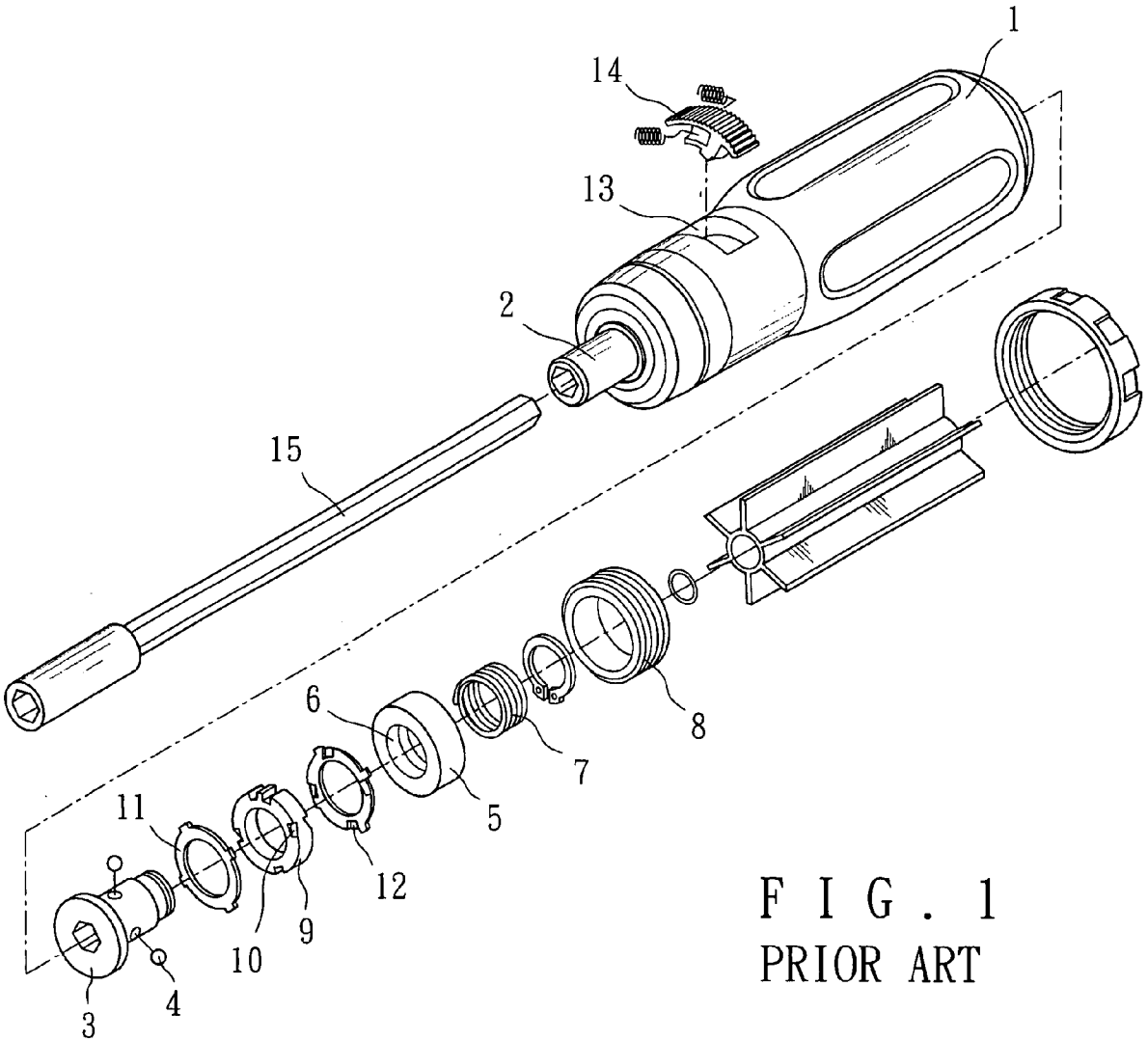
FIG. 1 PRIOR ART
FIG. 1 is an exploded view of a screwdriver with a prior sectionless length adjustment mechanism to be mounted in its handle.
Figure 2:
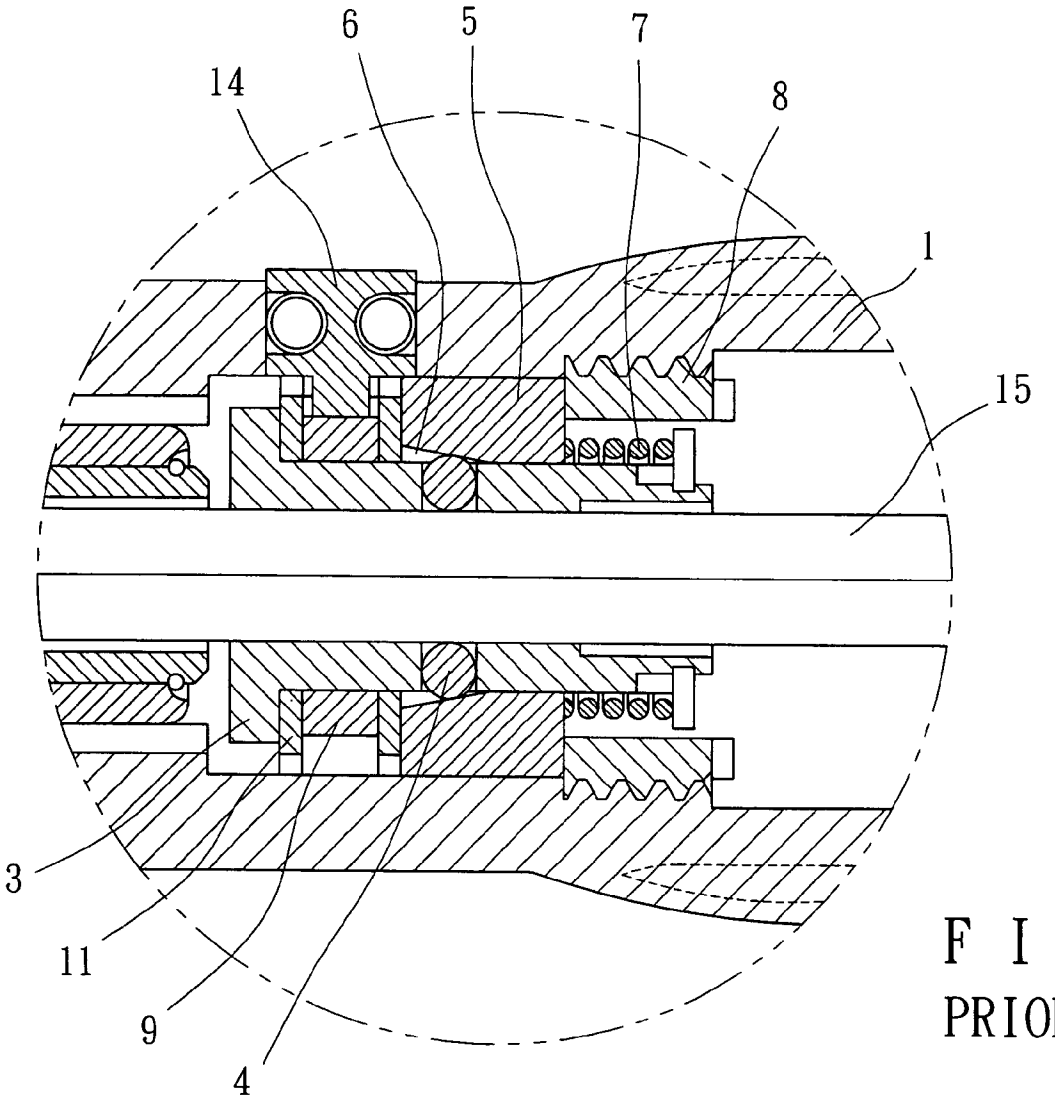
FIG. 2 PRIOR ART
FIGS. 2 and 3 are sectional views of the assembled mechanism in its inoperative and operative states respectively.
Figure 3:
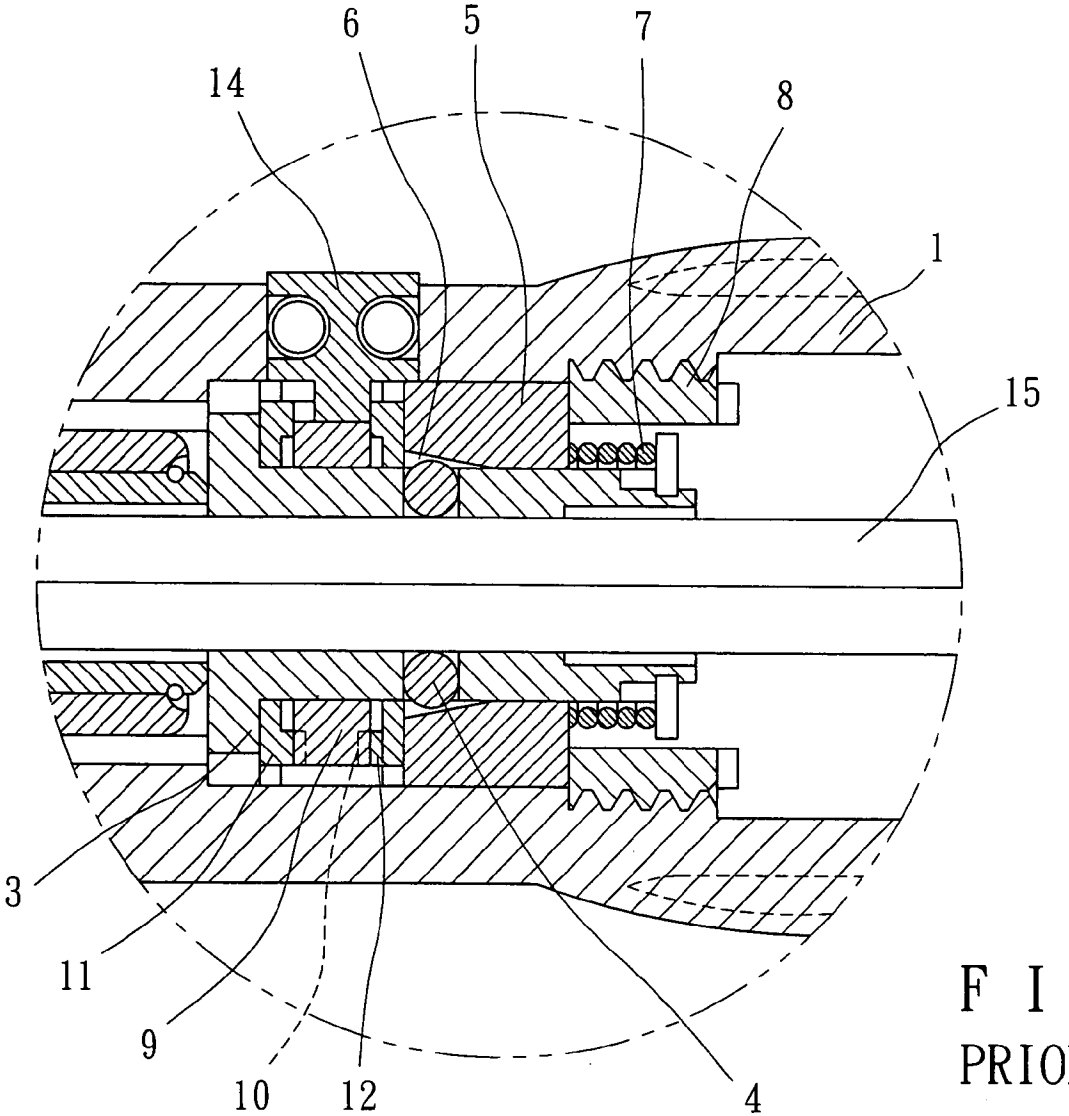
FIG. 3 PRIOR ART
Figure 4:
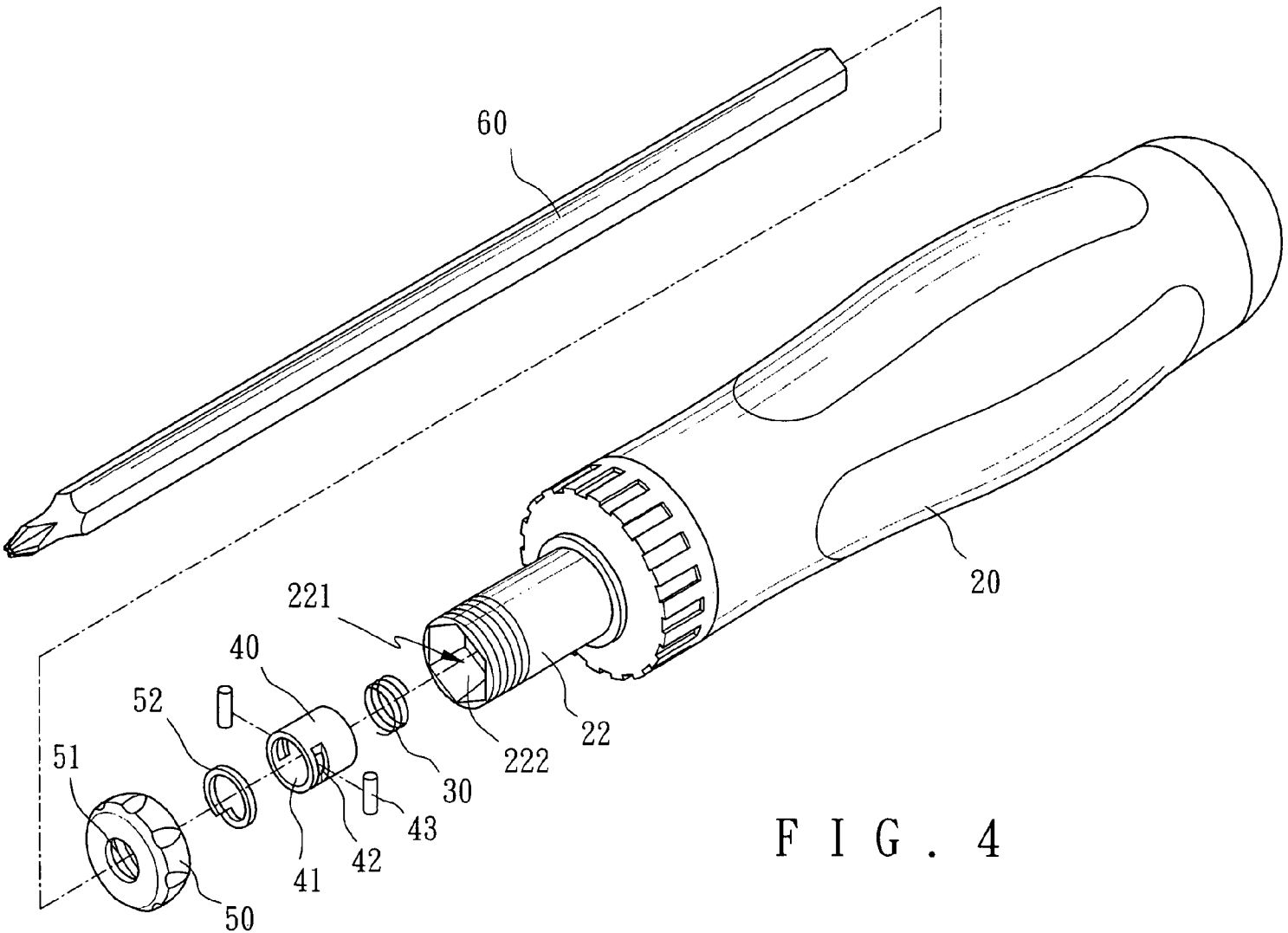
FIG. 4 is an exploded view of a screwdriver with a sectionless length adjustment mechanism according to a first preferred embodiment of the invention, the mechanism to be mounted in its handle.
Figure 5:
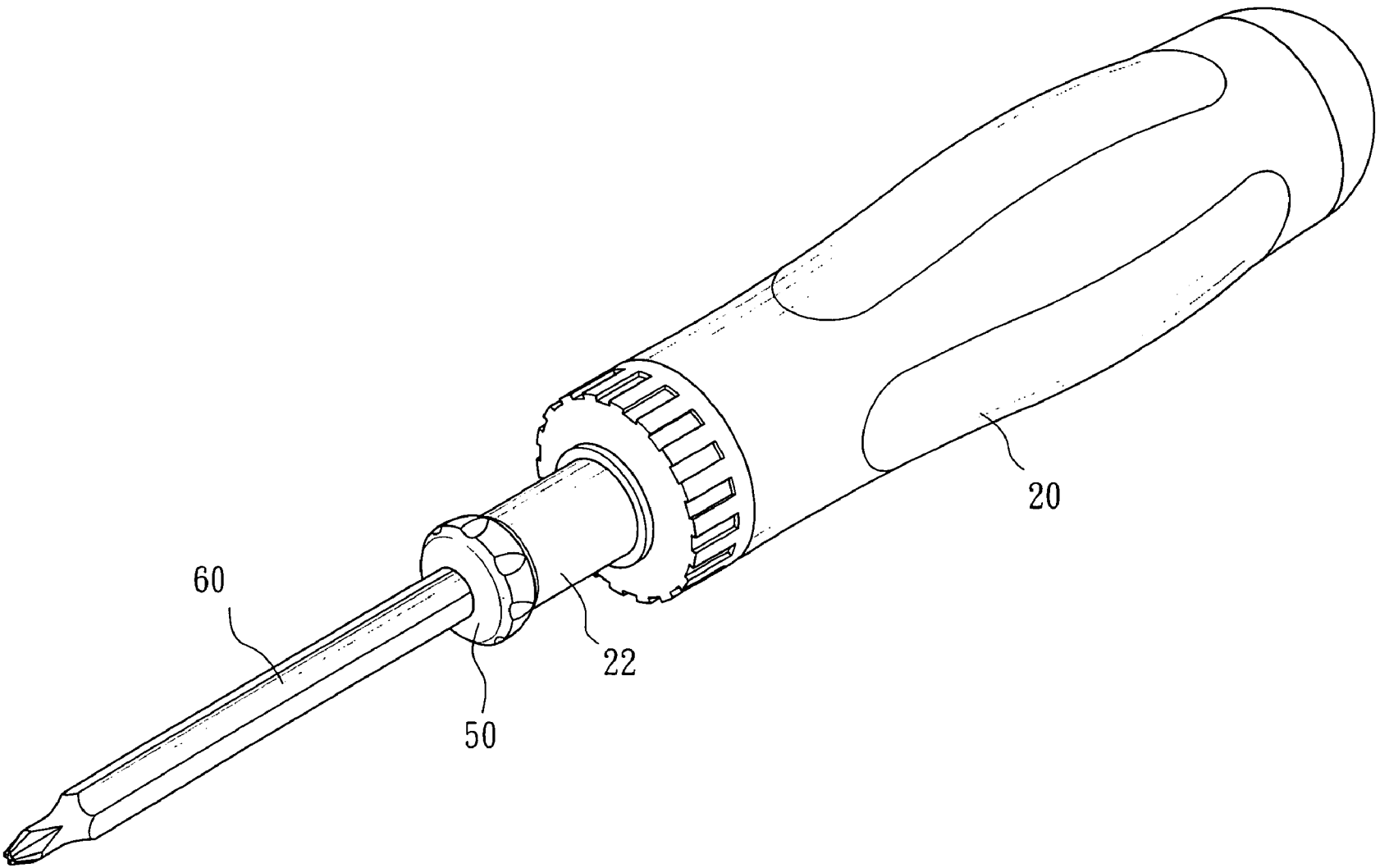
FIG. 5 is a perspective view of the assembled mechanism of FIG. 4.
Figure 6:
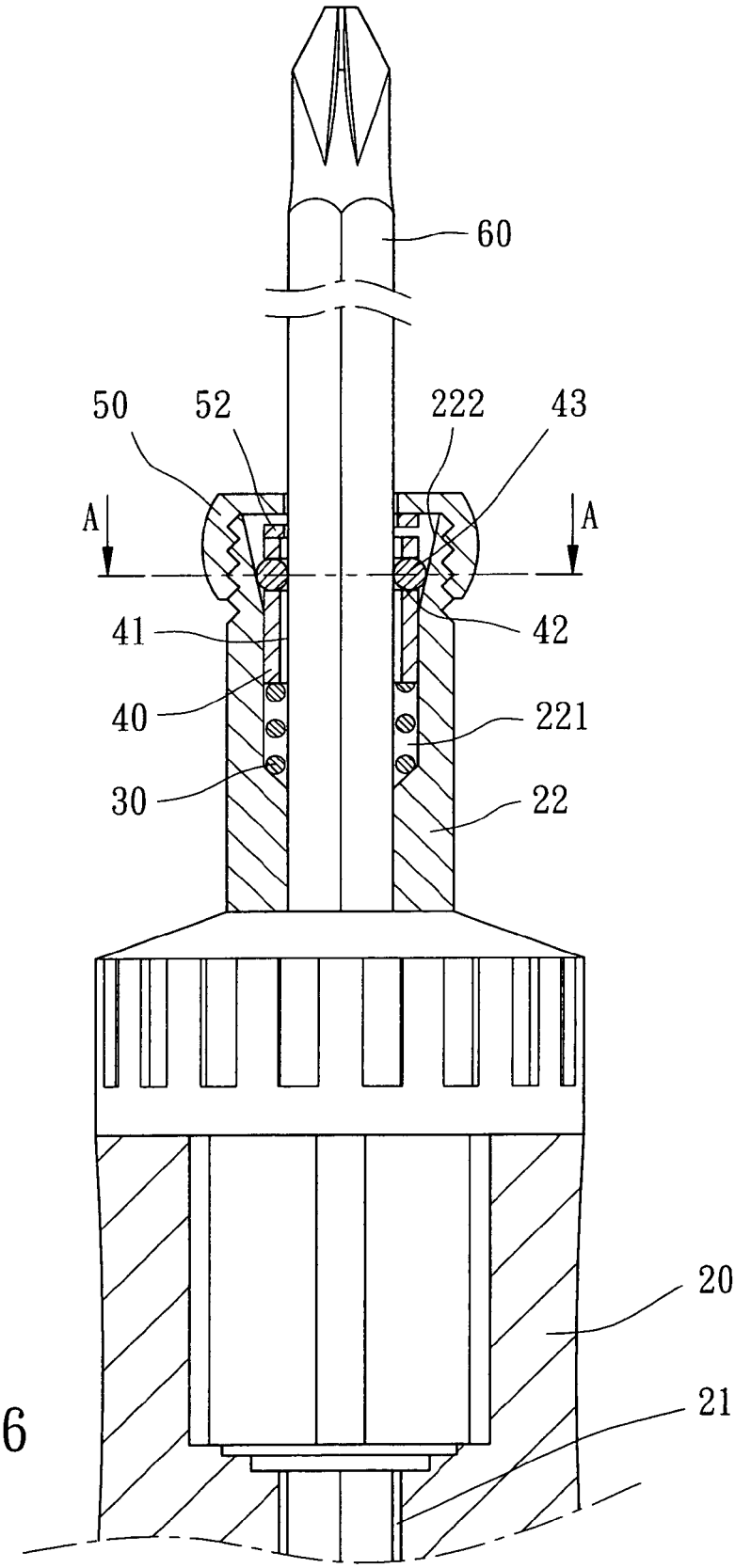
FIG. 6 is a sectional view of the screwdriver of FIG. 5.
Figure 7:
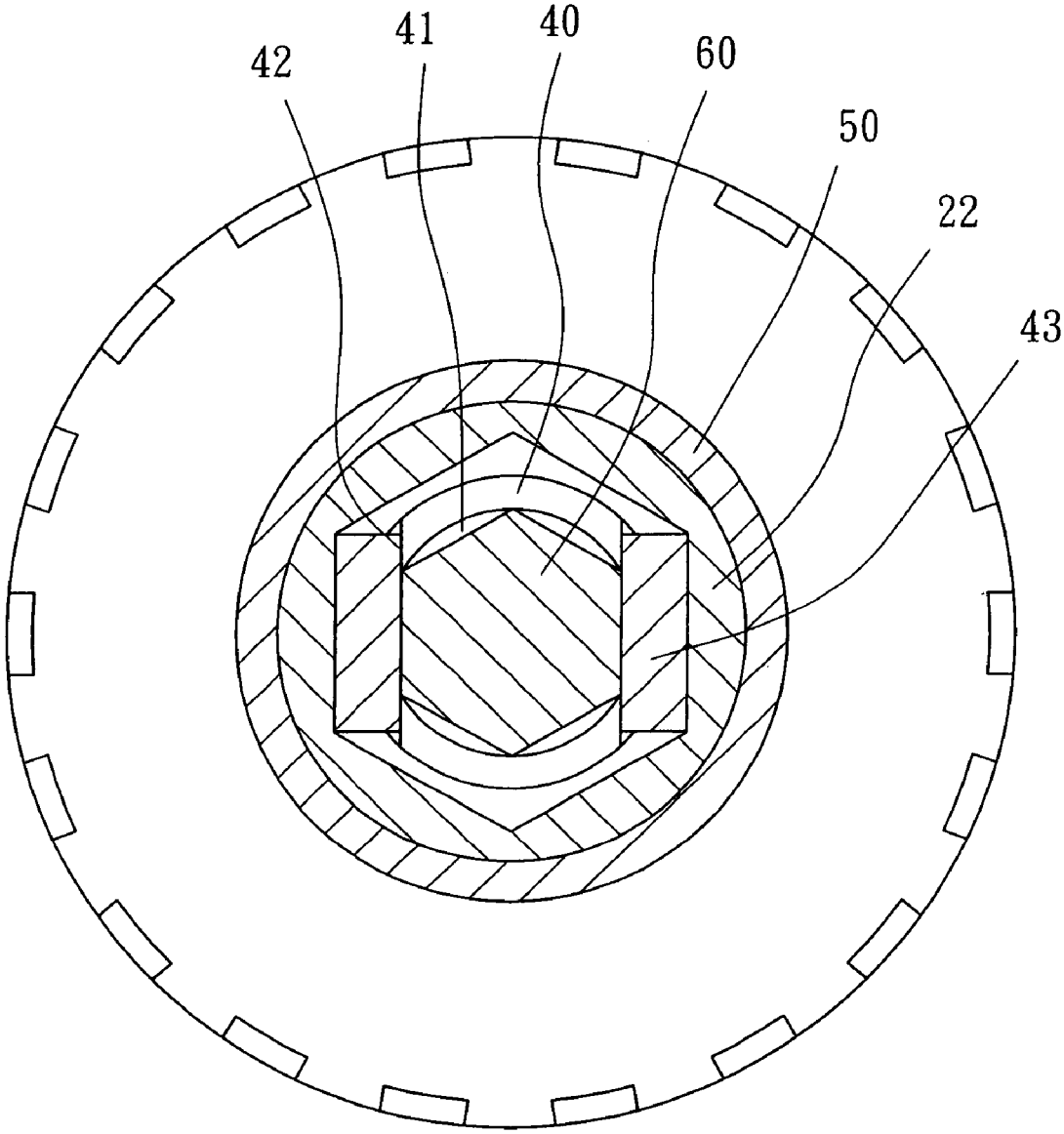
FIG. 7 is a sectional view taken along line A—A of FIG. 6.
Figure 8:
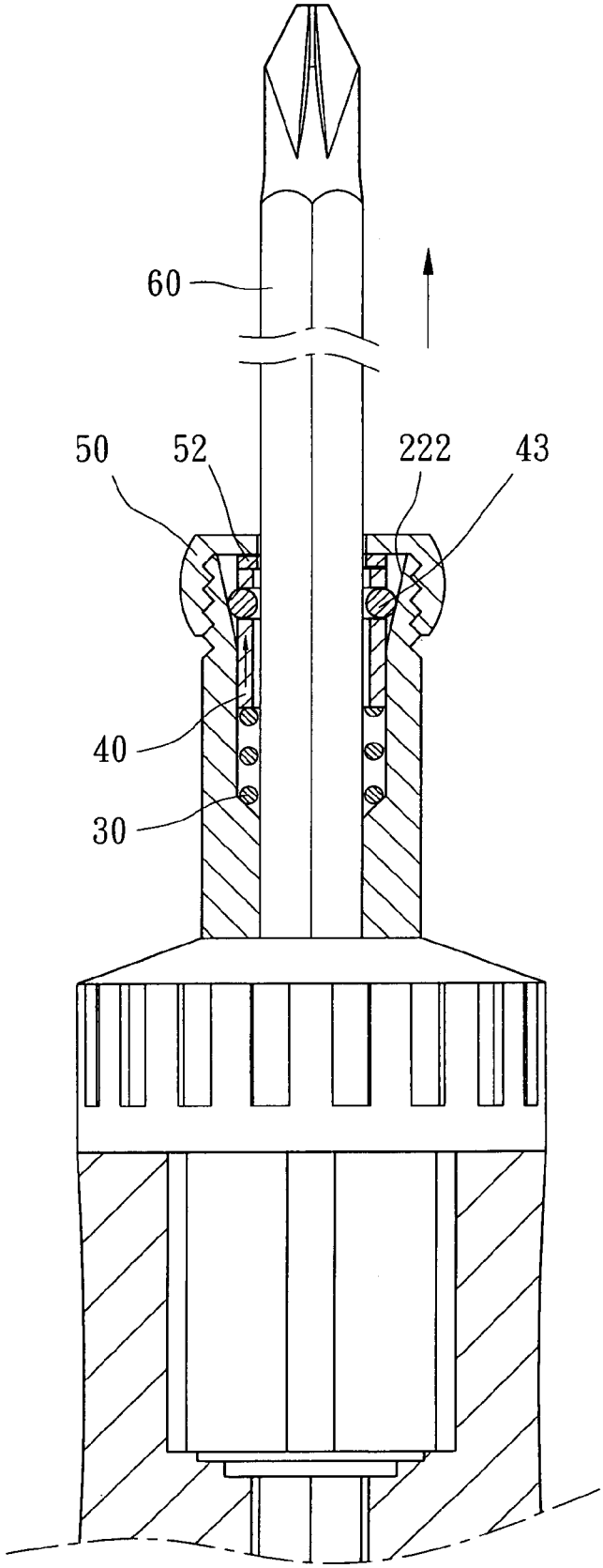
FIGS. 8, 9, and 10 are views similar to FIG. 6 for showing the shank in an extending operation, a retracting operation, and a fully retracted position respectively.
Figure 9:
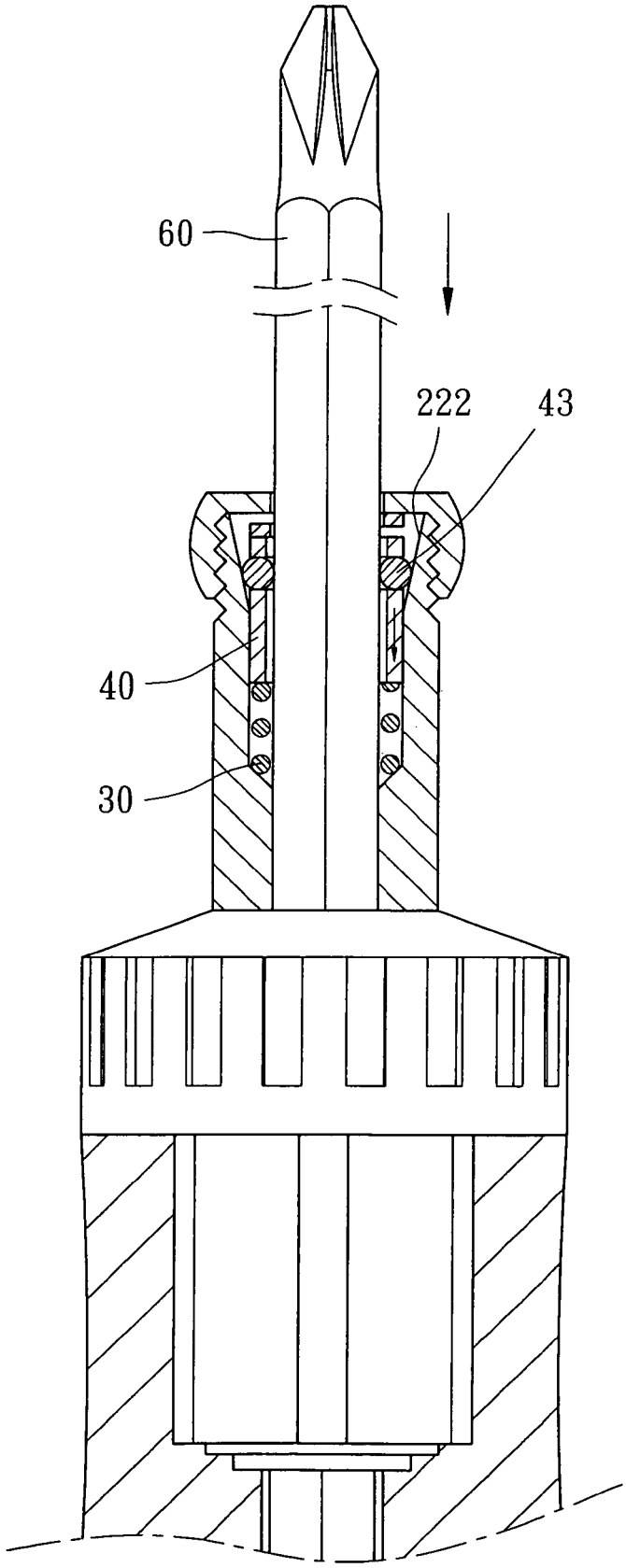
Figure 10:
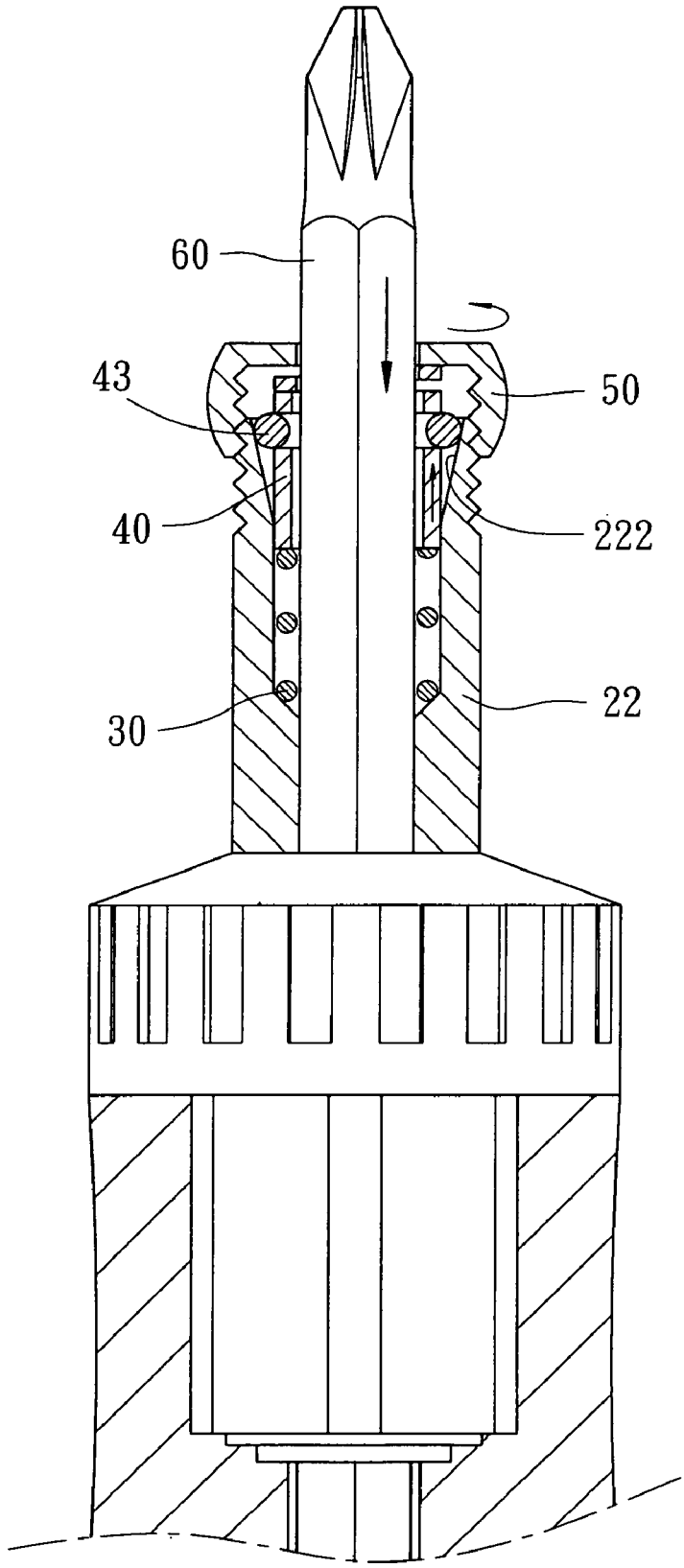

Referring to FIGS. 4 to 7, there is shown a screwdriver having a sectionless length adjustment mechanism in accordance with a first preferred embodiment of the invention. A sleeve 22 is forwardly extended a short distance from a handle 20 of the screwdriver. The sleeve 22 has a bore 221 of hexagon. The bore 221 is of staged and includes a front flared end 222, an externally threaded section around the flared end 222, and an inner portion with reduced diameter. The bore 221 is in communication with an internal bore 21 of the handle 20. A length adjustment mechanism is substantially provided in the, bore 221 of the sleeve 22 and comprises a spring 30 having its rear end contacted a slope of the inner portion of the bore 221, a shell 40 including a bore 41, two opposite slots 42 formed on its outer surface and being in communication with the bore 41, and two bars 43 provided in the slots 42, the shell 40 having its rear end contacted a front end of the spring 30, and a nut 50 including a bore 51 and a C-shaped resilient member 52. Finally, a shank 60 of hexagonal section is inserted through the nut 50, the shell 40, the spring 30, and the bore 221 to have its rear end slidably fastened in the bore 21 of the handle 20. In this assembled state of the screwdriver, the nut 50 is driven home (i.e., threadedly secured to the externally threaded section of the sleeve 22) to hold other components of the mechanism in place with the resilient member 52 being obliquely compressed between a front end of the shell 40 and a front inner wall of the nut 50, the spring 30 being compressed, outer portions of the bars 43 being in contact with two of six opposite internal faces of the flared end 222, and inner portions of the bars 43 being in contact with two of six opposite faces of the shank 60 as shown in FIGS. 6 and 7. Referring to FIGS. 8, 9, and 10, length adjusting operation of the shank 60 will be described in detailed below. In FIG. 8, for extending the shank 60, a user may pull the shank 60 forward with one hand by holding the handle 20 with the other hand. The bars 43 thus move outward forward along the opposite faces of the flared end 222 to compress the resilient member 52 with the spring 30 being expanded. The forward sliding of the shank 60 can be stopped at any desired position relative to the handle 20. That is, the length increase adjustment of the shank 60 can be made in a smooth, sectionless manner. Further, the shank 60 is lockingly engaged with the mechanism once the sliding of the shank 60 is stopped. In FIG. 9, for retracting the shank 60 to any desired position relative to the handle 20, the user may push the shank 60 rearward with one hand by holding the handle 20 with the other hand. The bars 43 thus move inward rearward along the opposite faces of the flared end 222 to compress the spring 30 with the resilient member 52 being slightly expanded. The rearward sliding of the shank 60 can be stopped at any desired position relative to the handle 20. That is, the length decrease adjustment of the shank 60 can also be made in a smooth, sectionless manner. Further, the shank 60 is lockingly engaged with the mechanism once the sliding of the shank 60 is stopped. In FIG. 10, after use the user may loosen the nut 50 by turning clockwise as indicated by arrow. As such, the shell 40 moves forward with both the spring 30 and the resilient member 52 being expanded. The user can determine whether the turning of the nut 50 is no more necessary by slightly sliding the shank 60. The shank 60 is free if the sliding is made very easy with no resistance. At this state, the bars 43 are disposed at the mouth of the flared end 222 and are disengaged from the shank 60, and the nut 50 is still threadedly secured to the sleeve 22. Preferably, the shank 60 is retracted to its shortest length in the sleeve 22 for ease of storage.

Figure 11:
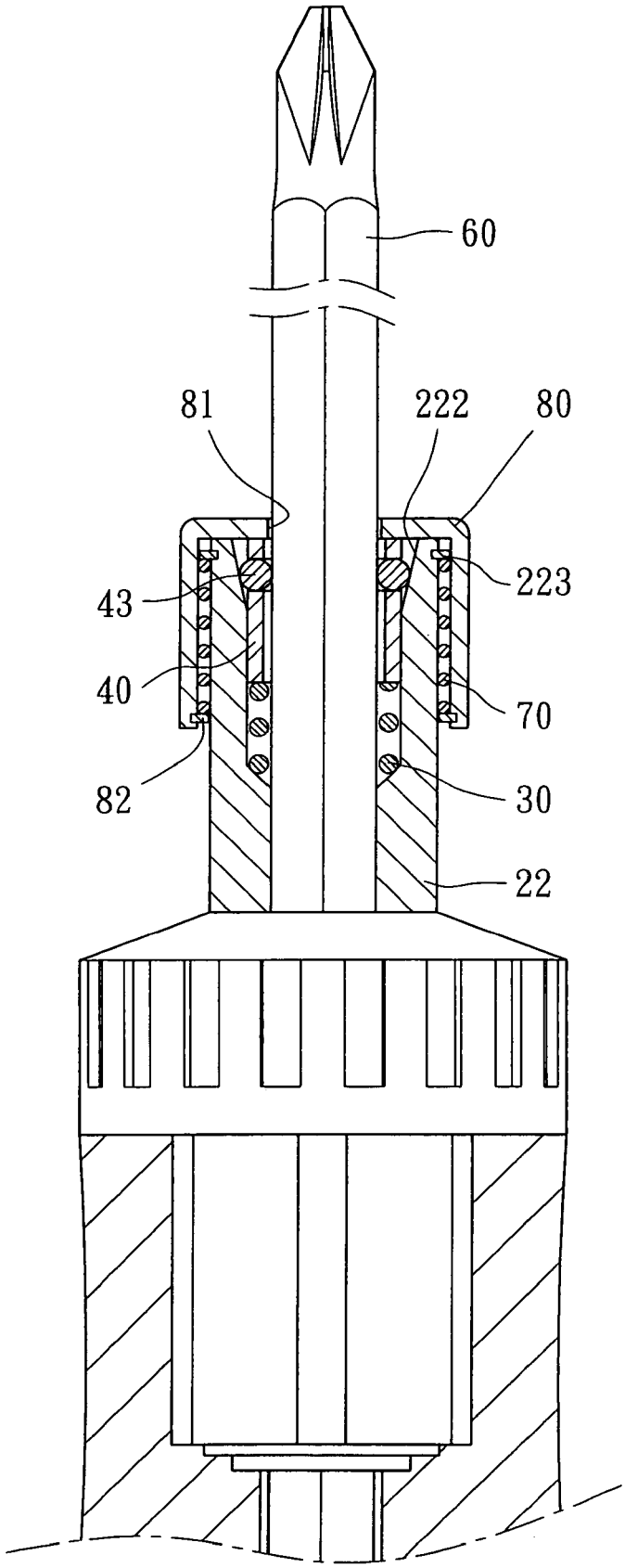
FIG. 11 is a sectional view of a screwdriver with a sectionless length adjustment mechanism according to a second preferred embodiment of the invention.

Referring to FIG. 11, there is shown a screwdriver having a sectionless length adjustment mechanism in accordance with a second preferred embodiment of the invention. The second preferred embodiment substantially has same structure as the first preferred embodiment. The differences between the first and the second preferred embodiments, i.e., the characteristics of the second preferred embodiment are detailed below. The externally threaded section around the flared end of the sleeve 22 is is eliminated and is the outer surface around the flared end 222 of the sleeve 22 is shaped as a smooth one: The nut 50 is replaced with the following components. A spring 70 is put on a front end of the sleeve 22. A first C-shaped clip 233 is put on an annular groove proximate the front end of the sleeve 22 and is urged by a front end of the spring 70. A cap 80 comprises a central aperture 81 with the shank 60 passed and a second C-shaped clip 82 put on an annular groove proximate a rear end thereof so as to be urged by a rear end of the spring 70 in response to mounting the cap 80 on a front portion of the sleeve. 22. As such, the spring 70 is compressed between the first and second C-shaped clips 223 and 82.

Figure 12:
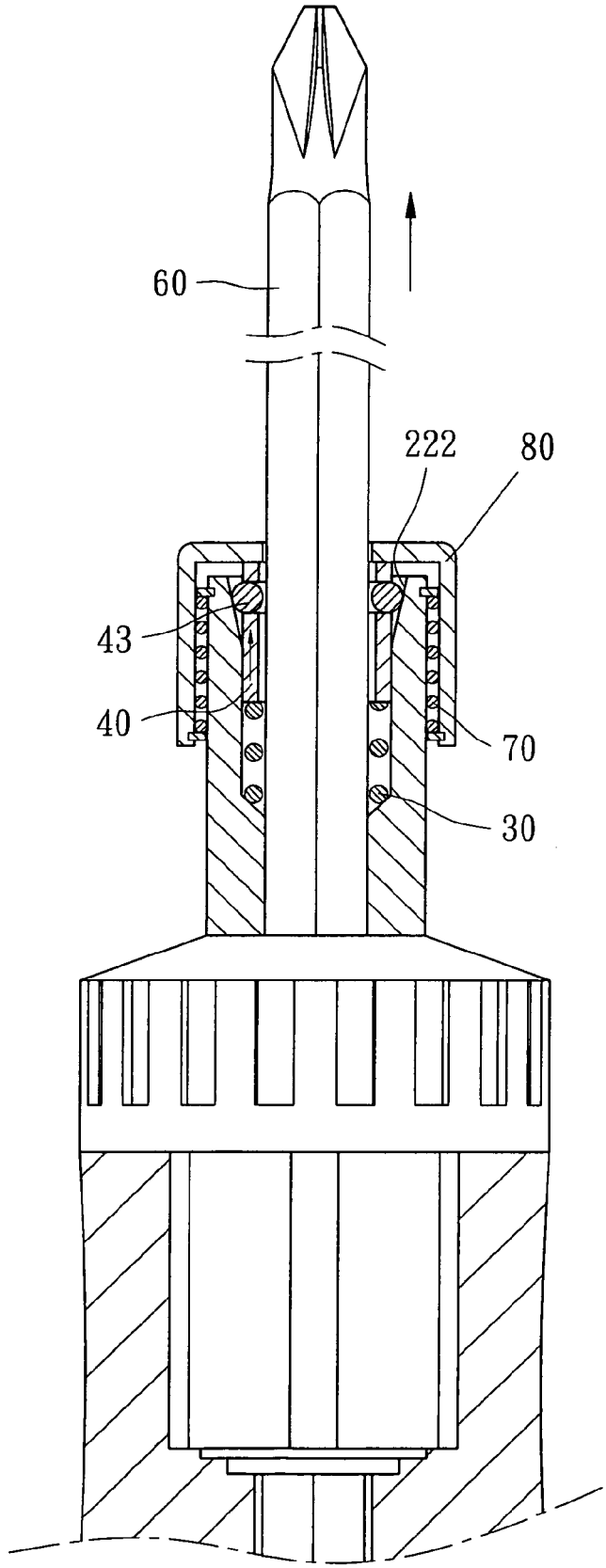
FIGS. 12, 13, and 14 are views similar to FIG. 11 for showing the shank in an extending operation, a retracting operation, and a fully retracted position respectively.
Figure 13:
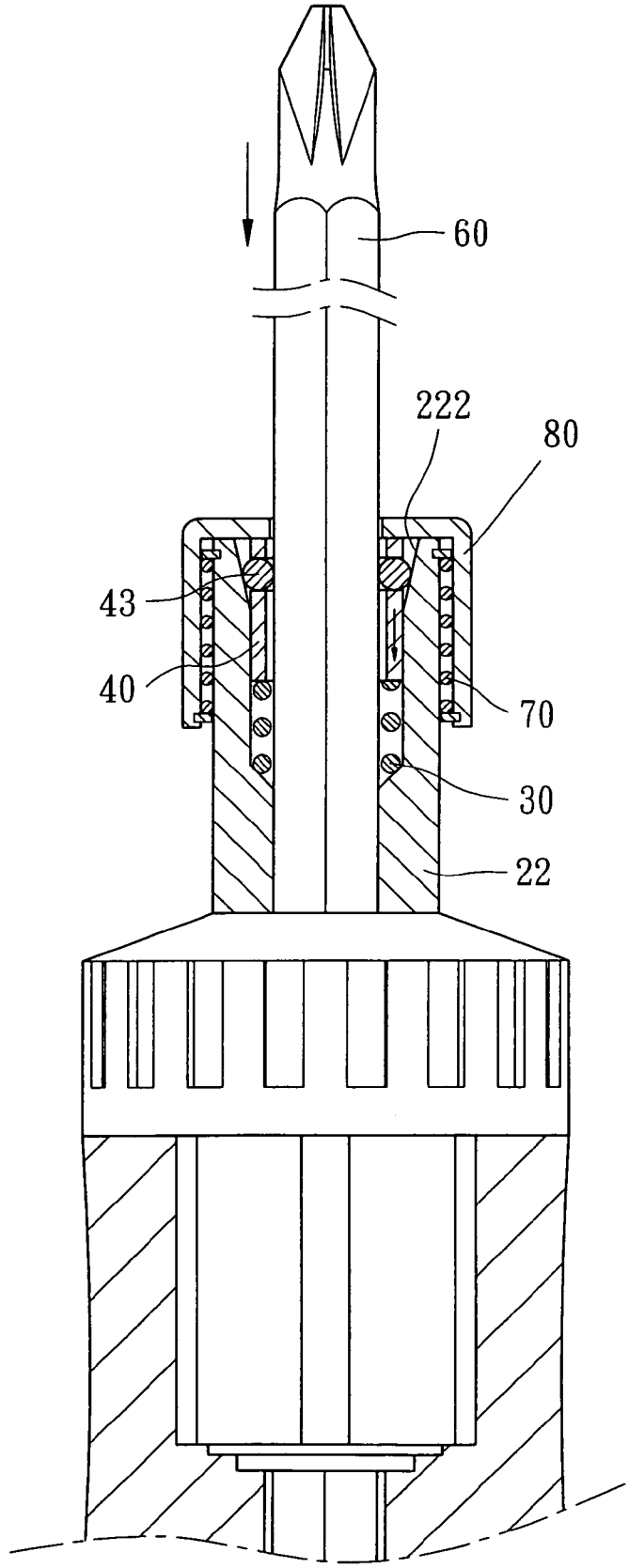
Figure 14:
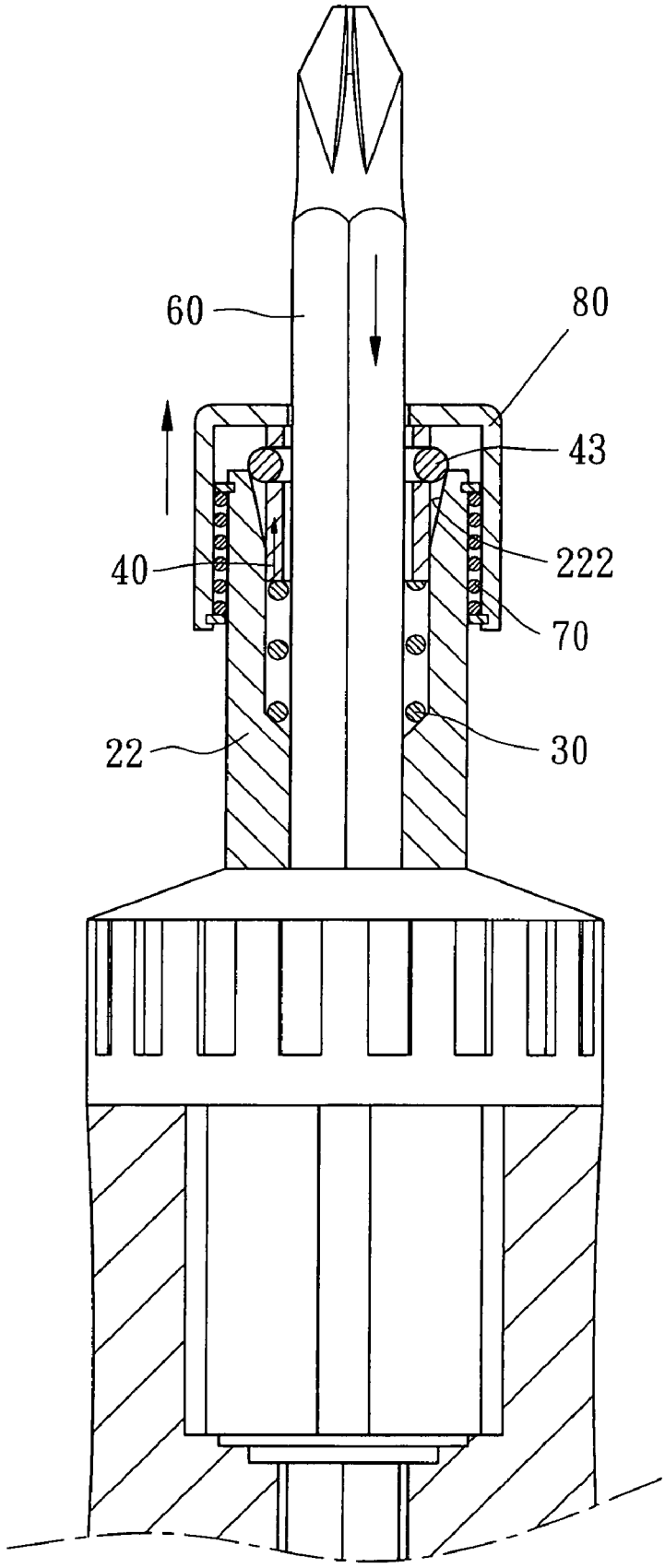

Referring to FIGS. 12, 13, and 14, length adjusting operation of the shank 60 will be described in detailed below. In FIG. 12, for extending the shank 60, a user may pull the shank 60 forward with one hand by holding the handle with the other hand. The bars 43 thus move outward forward along the opposite faces of the flared end 222 to disengage a front end of the sleeve 22 from a front inner wall of the cap 80 with the spring 70 being compressed and the spring 30 being expanded. The forward sliding of the shank 60 can be stopped at any desired position relative to the handle. That is, the length increase adjustment of the shank 60 can be made in a smooth, sectionless manner. Further, the shank 60 is lockingly engaged with the mechanism once the sliding of the shank 60 is stopped. In FIG. 13, for retracting the shank 60 to any desired position relative to the handle 20, the user may push the shank 60 rearward with one hand by holding the handle with the other hand. The bars 43 thus move inward rearward along the opposite faces of the flared end 222 to compress the spring 30 with the spring 70 being expanded. As shown, the front end of the sleeve 22 contacts the front inner wall of the cap 80 at the end of the adjustment. Note that the rearward sliding of the shank 60 can be stopped at any desired position relative to the handle 20 other than above. That is, the length decrease adjustment of the shank 60 can also be made in a smooth, sectionless manner. Further, the shank 60 is lockingly engaged with the mechanism once the sliding of the shank 60 is stopped. In FIG. 14, after use the user may pull the cap 80 forward with one hand by holding the handle with the other hand. As such, the spring 70 is compressed. The user can determine whether the pulling is no more necessary by slightly sliding the shank 60. The shank 60 is free if the sliding is made very easy with no resistance. At this state, the bars 43 are disposed at the mouth of the flared end 222 and are disengaged from the shank 60, and the cap 80 is still connected to the sleeve 22. Preferably, the shank 60 is retracted to its shortest length in the sleeve 22 for ease of storage.

While the invention herein disclosed has been described by means of specific embodiments, numerous modifications and variations could be made thereto by those skilled in the art without departing from the scope and spirit of the invention set forth in the claims.

What is claimed is:

1. An adjustment mechanism mountable in a joining portion of a handle of a tool and a shank of multi-sided section thereof for releasably locking the shank in any one of a plurality of positions relative to the handle, comprising:

a sleeve forwardly extended from the handle, the sleeve including a multi-sided bore of staged, a front flared end, an externally threaded section around the flared end, and an inner portion with reduced diameter, the bore of the sleeve being in communication with an internal bore of the handle;

a resilient member having its rear end contacted a slope of the bore of the sleeve;

a shell including two opposite slots formed on its outer surface and being in communication with its inside, and two bars provided in the slots, the shell having its rear end contacted a front end of the resilient member; and a nut threadedly secured to the externally threaded section of the sleeve, wherein the shank is inserted through the nut, the shell, the resilient member, and the bore of the sleeve to have its rear end slidably fastened in the bore of the handle with outer portions of the bars being in contact with internal faces of the flared end, and inner portions of the bars being in contact with faces of the shank, whereby pulling the shank forward will move the bars outward forward along the flared end to expand the resilient member for extending the shank; and stopping sliding the shank will lockingly engage the shank;

pushing the shank rearward will move the bars inward rearward along the flared end to compress the resilient member for retracting the shank, and stopping sliding the shank will lockingly engage the shank; and loosening the nut will move the shell forward and expand the resilient member until the shank is free to slide with the bars disposed at a mouth of the flared end and disengaged from the shank.

2. The adjustment mechanism of claim 1, wherein the resilient member is a spring.

3. The adjustment mechanism of claim 1, wherein each of the shank, the bore of the sleeve, and the bore of the handle is of hexagon.

4. The adjustment mechanism of claim 1, further comprising a C-shaped second resilient member obliquely compressed between a front end of the shell and a front inner wall of the nut.

5. An adjustment mechanism mountable in a joining portion of a handle of a tool and a shank of multi-sided section thereof for releasably locking the shank in any one of a plurality of positions relative to the handle, comprising:

a sleeve forwardly extended from the handle, the sleeve including a multi-sided bore of staged, a front flared end, a first annular groove proximate its front end, a first C-shaped clip put on the first annular groove, and an inner portion with reduced diameter, the bore of the sleeve being in communication with an internal bore of the handle;

a first resilient member having its rear end contacted a slope of the bore of the sleeve;

a shell including two opposite slots formed on its outer surface and being in communication with its inside, and two bars provided in the slots, the shell having its rear end contacted a front end of the resilient member;

a cap including a central aperture, a second annular groove proximate its rear end, and a second C-shaped clip put on the second annular groove;

a second resilient member put on the front end of the sleeve and compressed between the first and second C-shaped clips in response to mounting the cap on the front end of the sleeve, wherein the shank is inserted through the cap, the shell, the first resilient member, and the bore of the sleeve to have its rear end slidably fastened in the bore of the handle with outer portions of the bars being in contact with internal faces of the flared end, and inner portions of the bars being in contact with faces of the shank, whereby pulling the shank forward will move the bars outward forward along the flared end to disengage from the shank and disengage the front end of the sleeve from the cap with the second resilient member being compressed and the first resilient member being expanded for extending the shank, and stopping sliding the shank will lockingly engage the shank;

pushing the shank rearward will move the bars inward rearward along the flared end to compress the first resilient member and expand the second resilient member for retracting the shank, and stopping sliding the shank will lockingly engage the shank; and pull the cap forward will move the shell forward and expand the second resilient member until the shank is free to slide with the bars disposed at a mouth of the flared end and disengaged from the shank.

6. The adjustment mechanism of claim 5, wherein each of the first and second resilient members is a spring.

7. The adjustment mechanism of claim 5, wherein each of the shank, the bore of the sleeve, and the bore of the handle is of hexagon.

* * * * *